US005794642A

United States Patent [19]

Zikeli et al.

[11] Patent Number: 5,794,642

[45] Date of Patent: Aug. 18, 1998

[54] PROCESS FOR TRANSPORTING THERMALLY UNSTABLE VISCOUS MASSES

[75] Inventors: Stefan Zikeli, Regau; Michael Longin, Lenzing; Friedrich Ecker, Timelkam, all of Austria

[73] Assignee: Lenzing Aktiengesellschaft, Lenzing, Austria

[21] Appl. No.: 814,258

[22] Filed: Mar. 10, 1997

[51] Int. Cl.[6] ..... E03B 1/00

[52] U.S. Cl. ..... 137/4; 137/13; 137/561 A

[58] Field of Search ..... 137/4, 13, 1, 561 A

[56] References Cited

U.S. PATENT DOCUMENTS

| | | | |
|---|---|---|---|
| 2,179,181 | 11/1939 | Graenacher et al. | 106/40 |
| 3,381,336 | 5/1968 | Wells | 18/8 |
| 3,496,261 | 2/1970 | Parr | 264/176 |
| 3,767,347 | 10/1973 | Landoni | 425/379 |
| 4,256,140 | 3/1981 | Swaroop et al. | 137/561 A |
| 4,881,566 | 11/1989 | Ubels et al. | 137/13 |
| 5,010,910 | 4/1991 | Hickey | 137/561 A |
| 5,040,558 | 8/1991 | Hickey et al. | 137/561 A |

FOREIGN PATENT DOCUMENTS

| | | |
|---|---|---|
| 553070 | 7/1993 | European Pat. Off. . |
| 1156967 | 11/1963 | Germany . |
| 1435633 | 1/1969 | Germany . |
| 1435359 | 5/1969 | Germany . |
| 2229857 | 12/1972 | Germany . |
| 9428208 | 12/1984 | WIPO . |

OTHER PUBLICATIONS

Knöck, H., Bestimmung Optimaler Rohrdurchmesser in Verteilungssystemen für Hochviskose Flüssigkeiten, Verfahrenstechnik 15:470–473 (1981).

Buijtenhuijs, et al., Das Papier 12:615–618 (1986).

*Primary Examiner*—A. Michael Chambers

*Attorney, Agent, or Firm*—Baker & Botts, LLP

[57] ABSTRACT

The invention is concerned with a process for transporting a thermally unstable viscous mass through pipes and is characterized in that (a) during transportation, the mass is divided into $X_1$ partial flows $T_1$, $X_1$ being calculated according to the relation $$X_1=Q^{(N-1)}, \quad \text{(I)}$$

wherein Q and N indicate positive integers independent from each other, and (b) the viscous mass in the partial flows is transported at the same rate.

32 Claims, 1 Drawing Sheet

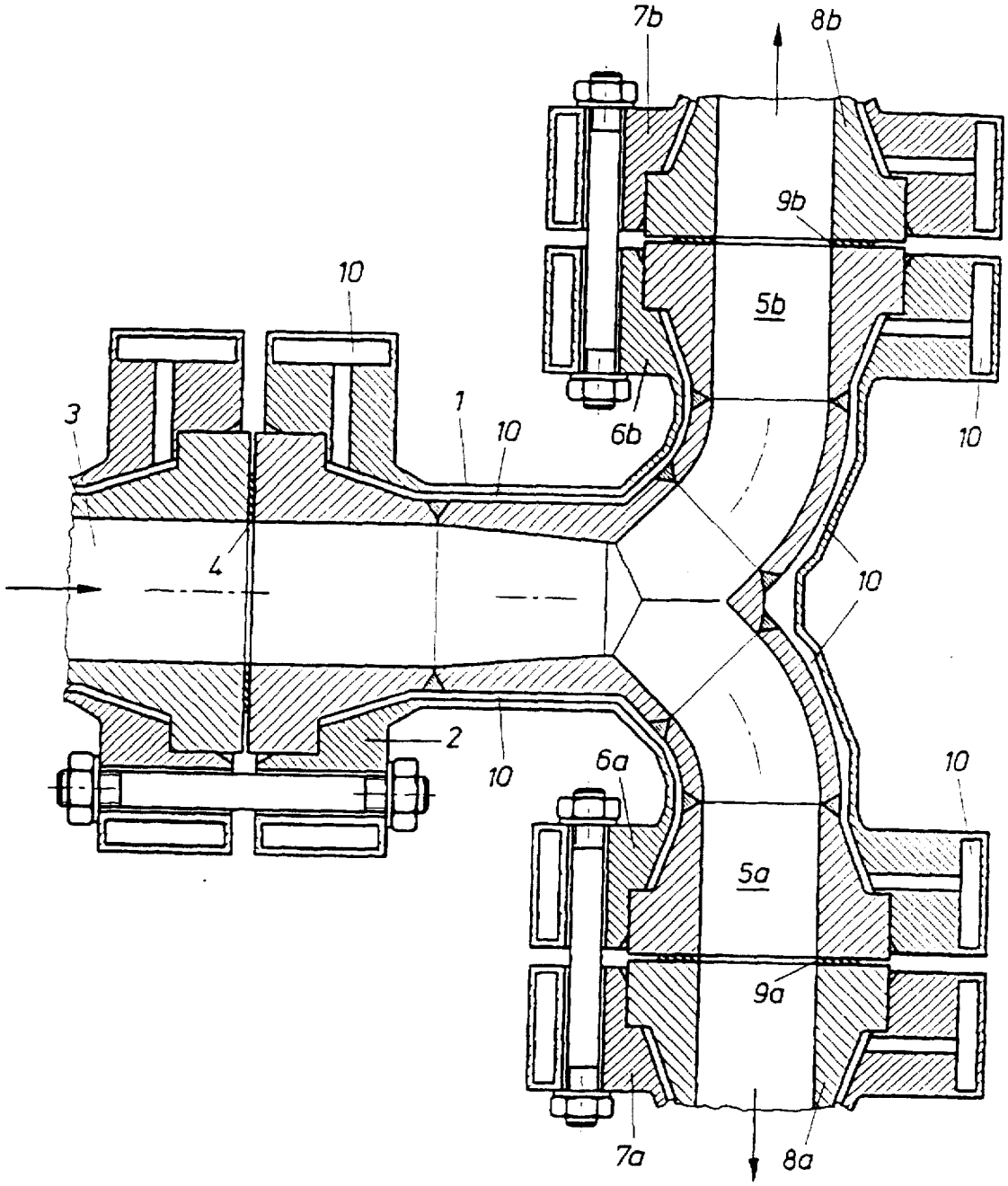
7b
8b
9b
5b
10
3
1
10
6b
10
4
10
2
10
6a
10
5a
9a
7a
8a

PROCESS FOR TRANSPORTING THERMALLY UNSTABLE VISCOUS MASSES

BACKGROUND OF THE INVENTION

The invention is concerned with a process for transporting thermally unstable viscous masses. In particular, the present invention is concerned with a process for transporting a dope containing cellulose and an aqueous tertiary amine-oxide.

For the purposes of the present specification and claims, the term dope is used for any viscous mass containing cellulose and an aqueous tertiary amine-oxide able to be processed to cellulose moulded bodies of any shape, particularly fibres and films.

Tertiary amine-oxides have been known as alternative solvents for cellulose. It is known for instance from U.S. Pat. No. 2,179,181 that tertiary amine-oxides are capable of dissolving cellulose without derivatisation and that from these solutions cellulose moulded bodies, such as fibres, may be produced by precipitation. From EP-A-0 553 070 of the applicant, further tertiary amine-oxides are known. In the following, all tertiary amine-oxides capable of dissolving cellulose are meant when, for the sake of simplicity, only NMMO (=N-methylmorpholine-N-oxide) is cited.

As alternative solvents, tertiary amine-oxides are advantageous insofar as the cellulose is dissolved by the NMMO without derivatisation, contrary to the viscose process. Thus the cellulose does not have to be chemically regenerated, the NMMO remains chemically unchanged and passes during its precipitation into the precipitation bath and may be recovered from the latter and reused for the preparation of new solution. Therefore the NMMO process offers the possibility of a closed solvent cycle. Additionally, NMMO has an extremely low toxicity.

However, when cellulose is dissolved in NMMO, the polymerisation degree of the cellulose decreases. Moreover, particularly the presence of metal iones (such as $Fe^{3+}$) leads to radically initiated chain cleavages and thus to a significant degradation of the cellulose and the solvent (Buijtenhuijs et al. The Degradation and Stabilization of Cellulose Dissolved in N-Methylmorpholin-N-Oxide (NMM), in "Das Papier", Volume 40, number 12, pages 615–619, 1986).

On the other hand, amine-oxides generally have only a limited thermal stability which varies depending on their structure. Under normal conditions, the monohydrate of NMMO is present as a white crystalline solid, which melts at 72° C. Its anhydric compound however melts at no less than 172° C. When heating the monohydrate, strong discoloration will occur from 120°/130° C. up. From 175° C. up, an exothermal reaction is initiated, the melted mass being completely dehydrated and great amounts of gas developing which eventually lead to an explosion, the temperatures rising to far over 250° C.

It is known that metallic iron and copper and particularly their salts significantly reduce the decomposition temperature of NMMO, while the decomposition rate is simultaneously increased.

Moreover, additionally to the problems mentioned above, there is another difficulty, i.e. the thermal instability of the NNMMO/cellulose solutions themselves. This means that at the elevated processing temperatures (approximately 110–120° C.), uncontrollable decomposition processes are initiated in the solutions which due to the development of gases may lead to strong deflagrations, fires and even explosions.

It is evident that the decomposition products of the cellulose and the amine-oxide have a negative effect on the mechanical properties of the cellulose moulded body. This applies particularly to the production of fibres and films. Thus efforts are made on the one hand to prevent the formation of decomposition products by adding stabilizers and on the other to keep the residence time of the cellulose solution to be processed as short as possible. These efforts however have a limit, since at an industrial scale usually significantly more cellulose solution per time unit is produced than can be taken up by e.g. a spinneret. When several spinnerets are used, the problem of dividing the dope arises, a number of partial streams or flows being provided wherein different decomposition processes will occur, the products of which will influence the mechanical properties of each of the moulded bodies in a different way. This means again that the production of moulded bodies having uniform properties cannot be assured by the industrial process.

SUMMARY OF THE INVENTION

This is the starting point of the present invention: It is its object to provide a process for transporting thermally unstable viscous masses, particularly a process for transporting a dope containing cellulose and an aqueous tertiary amine-oxide, which do not exhibit the above problems.

The process according to the invention for transporting a thermally unstable viscous mass through pipes is characterized in that (a) during transportation, the mass is divided into $X_1$ partial flows $T_1$, $X_1$ being calculated according to the relation $$X_1=Q^{(N-1)}, \quad (I)$$

wherein Q and N indicate positive integers independent from each other, and (b) the viscous mass in the partial flows is transported at the same rate.

BRIEF DESCRIPTION OF THE DRAWING

FIG. 1 is a cross-section of an apparatus for dividing a mass flow in accordance with the invention.

DETAILED DESCRIPTION OF THE PREFERRED EMBODIMENT

It has been shown that when the mass is divided into partial flows it is of vital importance to transport the mass in the partial flows at the same rate through the pipes. Thus it is assured that the mass which finally arrives at the forming tool has the same thermal history, so that moulded bodies having uniform properties may be produced.

From WO 94/28208 it is known to transport a solution of cellulose in NMMO through a branching valve whereby the solution is optionally directed to one of two filters. Under normal operation, one filter is always in a "stand-by" position. To provide a continuous operation while the filter is changed, during the time one filter is being changed the other filter is operated. Moreover, it is mentioned that by adjusting the branching valve in an intermediate position, the solution may be divided into two flows and transported to two filters. To those skilled in the art however, it is not evident from WO 94/28208 that the cellulose solutions are to be transported at the same rate, thus allowing a uniform quality of the moulded bodies.

To promote the uniform thermal history of the mass, static mixers may be employed to level the temperature and viscosity differences possibly present in the mass.

When dividing the mass into partial flows, it is best assured by means of a reduction of the pipe diameters that the rate does not drop due to the reduction of its volume when the mass is divided. Thus a uniform rate profile is achieved which is particularly advantageous regarding an equal residence time.

A preferred embodiment of the process according to the invention consists in that the $X_1$ partial flows $T_1$ are further divided into $X_2$ partial flows $T_2$, $X_2$ being calculated according to the relation $$X_2=X_1\cdot Q^{(N-1)}, \quad \text{(II)}$$

wherein Q and N denote positive integers independent from each other.

It is further preferred to divide the $X_2$ partial flows $T_2$ into $X_3$ partial flows $T_3$, $X_3$ being calculated according to the relation $$X_3=X_2\cdot Q^{(N-1)}, \quad \text{(III)}$$

wherein Q and N denote positive integers independent from each other.

Each of the partial flows $T_3$ may be divided at least one more time.

Q denotes preferably the number 2.

It is further preferred that in the relations (I), (II) and (III), Q refers to different integers.

N denotes preferably an integer between 2 and 12, preferably between 5 and 10.

A preferred embodiment of the process according to the invention consists in transporting the same amount of viscous mass per time unit in each of the $X_1$ partial flows $T_1$, in each of the $X_2$ partial flows $T_2$ and in each of the $X_3$ partial flows $T_3$.

It has been shown that the process according to the invention is particularly appropriate to transport a solution of cellulose in an aqueous, tertiary amine-oxide, the cellulose solution being best divided into $X_n$ partial flows and being transported to X forming tools, particularly spinnerets.

The dividing of the viscous mass is best carried out in a pipe component shown in the attached drawing.

In the drawing, a pipe element for dividing a mass flow is shown. The transport direction of the mass is indicated by arrows.

The pipe element consists of a crosspiece 1 whereby the mass flow is divided into two equal partial flows. The feeding of the mass and the branching of the partial flows is carried out conveniently by means of transportation elements such as pumps. When highly viscous masses are transported, as is the case in the NMMO system, transportation will be carried out by forced transportation elements such as gear pumps etc. Between the crosspieces, different elements such as mixers, heat exchangers and pumps may be incorporated.

Crosspiece 1 is attached to a feeding pipe 3 by means of a flange 2 in a conventional manner. Between feeding pipe 3 and crosspiece 1 a seal 4 is provided. Similarly, crosspiece 1 is attached at its branchings 5*a* and 5*b* to counterflanges 7*a* and 7*b* respectively of branchings 8*a* and 8*b* by means of flanges 6*a* and 6*b*. Between flanges 6*a*, 6*b* and 7*a*, 7*b* respectively, seals 9*a* and 9*b* respectively are provided.

In crosspiece 1, a jacket 10 for a heating medium or a cooling medium is provided, whereby the temperature of the flowing viscous mass may be adjusted and controlled. Such heating jackets are also provided in counterflanges 7*a*, 7*b* of branchings 5*a* and 5*b* respectively and in the flange of feeding pipe 3. As a heating medium, water, vapour or thermo oil may be employed. As a cooling medium, water or thermo oil may be employed.

By means of providing crosspieces as the one shown in the drawing subsequently to each other, the mass flow may be divided into additional partial flows. Thus, according to the invention, 4, 8, 16, 32 etc. partial flows may be provided, depending on the number of crosspieces used. In this case, the number Q in the above mathematical relation therefore is 2.

Although the embodiment described above is preferred, it is also possible to divide the mass flow into 3 partial flows, whereby 3, 9, 27 etc. partial flows are provided. Therefore, in this case Q is the number 3.

Furthermore it may be provided that Q denotes different numbers in the divisions, e.g. the number 2 for a part of the divisions and the number 3 for the rest of the divisions.

We claim:

1. A process for transporting a thermally unstable viscous mass through pipes comprising (a) dividing said mass during transportation thereof into $X_1$ partial flows T, $X_1$ being calculated according to the relation $$X_1=Q^{(N-1)} \quad \text{(I)}$$

wherein Q and N are positive integers independent from each other, and (b) transporting all the vicious mass in each said partial flow at the same flow rate.

2. A process according to claim 1 further comprising:

dividing said $X_1$ partial flows $T_1$ into $X_2$ partial flows $T_2$, $X_2$ being calculated according to the relation $$X_2=X_1\cdot Q^{(N-1)} \quad \text{(II)}.$$

3. A process according to claim 2 further comprising:

dividing said $X_2$ partial flows $T_2$ into $X_3$ partial flows $T_3$, $X_3$ being calculated according to the following relation $$X_3=X_2\cdot Q^{(N-1)} \quad \text{(III)}.$$

4. A process according to claim 3 further comprising further dividing each of said partial flows $T_3$.

5. A process according to any one of claims 1, 2, 3 or 4 wherein Q is 2.

6. A process according to claim 5 wherein the viscous mass is a thermally unstable solution of cellulose in an aqueous tertiary amine oxide.

7. A process according to claim 6 wherein the viscous mass is a thermally unstable solution of cellulose in an aqueous tertiary amine oxide and further comprising transporting the $X_n$ partial flows of said cellulose solution to X forming tools.

8. A process according to claim 5 wherein the viscous mass is a thermally unstable solution of cellulose in an aqueous tertiary amine oxide and further comprising transporting the $X_n$ partial flows of said solution to X forming tools.

9. A process according to claim 3 wherein the integer Q is different in each of the relations (I), (II) and (III).

10. A process according to any one of claims 1, 2, 3 or 9 wherein N is an integer between 2 and 12.

11. A process according to claim 10 wherein N is an integer between 5 and 10.

12. A process according to claim 7 wherein the viscous mass is a thermally unstable solution of cellulose in an aqueous tertiary amine oxide.

13. A process according to claim 12 wherein the viscous mass is a thermally unstable solution of cellulose in an aqueous tertiary amine oxide and further comprising transporting the $X_n$ partial flows of said cellulose solution to X forming tools.

14. A process according to claim 11 wherein the viscous mass is a thermally unstable solution of cellulose in an aqueous tertiary amine oxide and further comprising transporting the $X_n$ partial flows of said cellulose solution to X forming tools.

15. A process according to claim 5 wherein the viscous mass is a thermally unstable solution of cellulose in an aqueous tertiary amine oxide.

16. A process according to claim 15 wherein the viscous mass is a thermally unstable solution of cellulose in an aqueous tertiary amine oxide and further comprising transporting the $X_n$ partial flows of said cellulose solution to X forming tools.

17. A process according to claim 10 wherein the viscous mass is a thermally unstable solution of cellulose in an aqueous tertiary amine oxide and further comprising transporting the $X_n$ partial flows of said cellulose solution to X forming tools.

18. A process according to claim 2 wherein the same amount of viscous mass per time unit is transported in each of said $X_2$ partial flows $T_2$.

19. A process according to claim 3 or claim 18 wherein the same amount of viscous mass per time unit is transported in each of said $X_3$ partial flows $T_3$.

20. A process according to claim 19 wherein the viscous mass is a thermally unstable solution of cellulose in an aqueous tertiary amine oxide.

21. A process according to claim 20 wherein the viscous mass is a thermally unstable solution of cellulose in an aqueous tertiary amine oxide and further comprising transporting the $X_n$ partial flows of said cellulose solution to X forming tools.

22. A process according to claim 7 wherein the viscous mass is a thermally unstable solution of cellulose in an aqueous tertiary amine oxide and further comprising transporting the $X_n$ partial flows of said cellulose solution to X forming tools.

23. A process according to any one of claims 1, 2, 3, 4, 9 or 18 wherein the viscous mass is a thermally unstable solution of cellulose in an aqueous, tertiary amine oxide.

24. A process according to any one of claims 1, 2, 3, 4, 9 or 18 wherein the viscous mass is a thermally unstable solution of cellulose in an aqueous tertiary amine oxide and further comprising transporting the $X_n$ partial flows of said cellulose solution to X forming tools.

25. A process according to claim 5 wherein N is an integer between 2 and 12.

26. A process according to claim 25 wherein the viscous mass is a thermally unstable solution of cellulose in an aqueous tertiary amine oxide and further comprising transporting the $X_n$ partial flows of said cellulose solution to X forming tools.

27. A process according to claim 25 wherein N is an integer between 5 and 10.

28. A process according to claim 27 wherein the viscous mass is a thermally unstable solution of cellulose in an aqueous tertiary amine oxide.

29. A process according to claim 28 wherein the viscous mass is a thermally unstable solution of cellulose in an aqueous tertiary amine oxide and further comprising transporting the $X_n$ partial flows of said cellulose solution to X forming tools.

30. A process according to claim 27 wherein the viscous mass is a thermally unstable solution of cellulose in an aqueous tertiary amine oxide and further comprising transporting the $X_n$ partial flows of said cellulose solution to X forming tools.

31. A process according to claim 2 wherein the viscous mass is a thermally unstable solution of cellulose in an aqueous tertiary amine oxide.

32. A process according to claim 31 wherein the viscous mass is a thermally unstable solution of cellulose in an aqueous tertiary amine oxide and further comprising transporting the $X_n$ partial flows of said cellulose solution to X forming tools.

* * * * *

UNITED STATES PATENT AND TRADEMARK OFFICE

CERTIFICATE OF CORRECTION

PATENT NO. : 5,794,642
DATED : August 18, 1998
INVENTOR(S) : Zikeli et al.

It is certified that error appears in the above-identified patent and that said Letters Patent is hereby corrected as shown below:

Title page,
After item [22], "filed: Mar. 10, 1977" should be:
-- PCT Filed: July 23, 1996
[86] PCT No. PCT/AT96/00133
§371 Date: Mar. 10, 1997
§102(e) Date: Mar. 10, 1997

[87] PCT Pub. No.: WO97/05305
PCT Pub. Date: Feb 13, 1997

[30] Foreign Application Priority Data
July 26, 1995 [AT] Austria...A 1279/95 --;

Column 1,
Line 60, "NNMMO/cellulose" should be -- NMMO/cellulose --;

Column 4,
Line 28, "vicious" should be -- viscous --.

Signed and Sealed this

Sixth Day of November, 2001

*Attest:*

Nicholas P. Godici

*Attesting Officer*

NICHOLAS P. GODICI
*Acting Director of the United States Patent and Trademark Office*